United States Patent [19]

Hoffman

[11] 4,248,168

[45] Feb. 3, 1981

[54] SEWING MACHINE ARRANGED FOR EDGE FOLLOWING BY NEEDLE MOVEMENT

[75] Inventor: Jay Hoffman, Livingston, N.J.

[73] Assignee: The Singer Company, Stamford, Conn.

[21] Appl. No.: 129,937

[22] Filed: Mar. 13, 1980

[51] Int. Cl.[3] ..... D05B 3/02

[52] U.S. Cl. ..... 112/158 E; 112/153; 112/306

[58] Field of Search ..... 112/158 E, 153, 306, 112/308, 121.11

[56] References Cited

U.S. PATENT DOCUMENTS

| | | | |
|---|---|---|---|
| 3,609,373 | 9/1971 | Desai et al. | 112/153 X |
| 3,970,014 | 7/1976 | Chano | 112/153 X |
| 4,191,121 | 3/1980 | Eguchi et al. | 112/158 E X |

*Primary Examiner*—Peter P. Nerbun

*Attorney, Agent, or Firm*—David L. Davis; Robert E. Smith; Edward L. Bell

[57] ABSTRACT

A sewing machine is disclosed wherein the position of the edge of a work fabric is sensed and signals are generated to control the needle jogging mechanism in order to sew a line of stitches a substantially constant predetermined distance from the edge.

3 Claims, 2 Drawing Figures

Fig.1
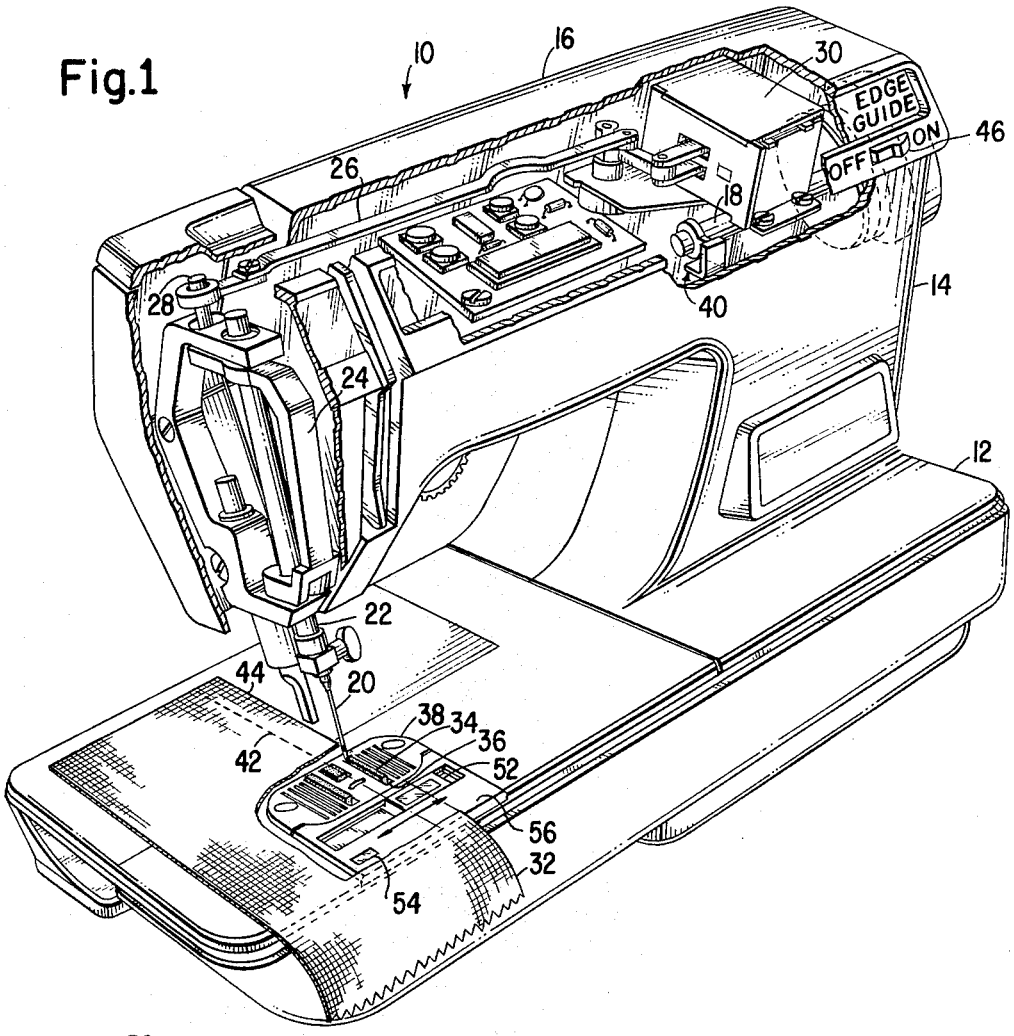
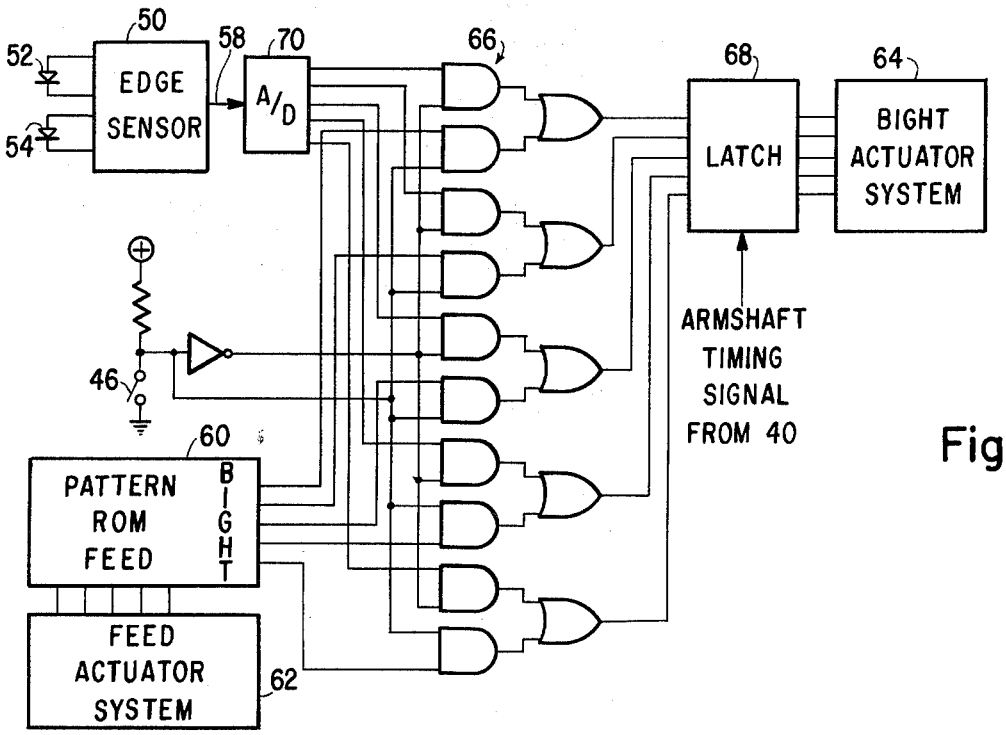
Fig.2

SEWING MACHINE ARRANGED FOR EDGE FOLLOWING BY NEEDLE MOVEMENT

BACKGROUND OF THE INVENTION

This invention relates to sewing machines and, more particularly, to an arrangement in a sewing machine for utilizing the lateral needle jogging mechanism for edge following.

There are many applications where it is desired to sew a line of stitches a substantially constant distance from the edge of a work fabric. To satisfy this need, there have been developed many arrangements for sensing the location of the edge and guiding the work fabric accordingly. Such arrangements are typically very complex and expensive to implement and therefore have found only limited acceptance, such acceptance being generally in the field of industrial sewing systems. However, many home sewers would be interested in having such a feature in their sewing machine. It would therefore be desirable to have a simpler, less expensive, arrangement for sewing a seam a predetermined distance from the edge of a work fabric. It would also be desirable to provide such an arrangement for incorporation in a household sewing machine.

It is therefore an object of this invention to provide a simple and inexpensive seam guiding arrangement.

It is another object of this invention to provide such an arrangement which may be incorporated in a household sewing machine.

SUMMARY OF THE INVENTION

The foregoing and additional objects are attained in accordance with the principles of this invention by providing an arrangement which utilizes the lateral jogging capability of a household sewing machine to effect seam guiding to sew a line of stitches a substantially constant predetermined distance from the edge of a work fabric. Means are provided for sensing the location of the edge of the work fabric in the general vicinity of the needle and for providing a signal representative of the distance between the edge and the needle. Additional means are provided which are responsive to that signal for controlling the needle jogging mechanism within the sewing machine to laterally position the needle the predetermined distance from the edge.

In accordance with an aspect of this invention, the arrangement further includes means for providing an adjustable operator controlled setting for the predetermined distance.

DESCRIPTION OF THE DRAWINGS

The foregoing will be more readily apparent upon reading the following description in conjunction with the drawings in which:

FIG. 1 is a perspective view of a sewing machine, partially broken away, in which an illustrative arrangement constructed in accordance with the principles of this invention is incorporated; and FIG. 2 is a block schematic diagram of illustrative circuitry constructed in accordance with the principles of this invention.

DETAILED DESCRIPTION

Referring to the drawings, wherein like elements in different figures thereof have the same reference character applied thereto, FIG. 1 illustrates a sewing machine indicated generally at 10 having incorporated therein illustrative apparatus constructed in accordance with the principles of this invention. The sewing machine 10 includes a bed 12, a standard 14 rising from the bed 12 and a bracket arm 16 overhanging the bed 12. The driving mechanism of the sewing machine includes an arm shaft 18 and a bed shaft (not shown) interconnected in timed relation by a conventional drive mechanism including a drive motor (not shown). A needle 20 is carried for endwise reciprocation by a needle bar 22 mounted for lateral jogging movement in a gate 24 in the bracket arm 16. Any conventional connections (not shown) may be used between the arm shaft 18 and the needle bar 22 for imparting needle reciprocation.

For imparting lateral jogging movement to the needle 20, a drive link 26 is pivoted at 28 to the gate 24 and provides the mechanical connection to a reversible linear actuator 30, illustratively of the type described in U.S. Pat. No. 4,016,441, issued Apr. 5, 1977. The linear actuator 30 may therefore be controlled to determine the lateral position of the sewing needle 20, as illustratively described in U.S. Pat. No. 3,984,745, issued Oct. 5, 1976, the disclosure of which is hereby incorporated by reference herein.

To impart motion to a work fabric 32, a feed dog 34 extends out of the bed 12 through slots 36 in a throat plate 38.

Also shown in FIG. 1 is a timing pulse generator 40 which may be of the type shown and described in U.S. Pat. No. 3,939,372, issued Feb. 17, 1976. The pulse generator 40 provides a train of timing pulses, one for each rotation of the arm shaft 18.

In accordance with the principles of this invention, the sewing machine 10 is provided with an arrangement for sewing a line of stitches 42 a substantially constant distance from the edge 44 of the work fabric 32. Although the edge 44 is illustrated as being straight, it is contemplated that this invention will be effective, within the confines of the extent of lateral excursion of the needle 20, independent of the contour of the edge 44.

In the past, when the user of a conventional household sewing machine desired to sew a line of stitches a substantially constant distance from the edge of a work fabric, the work fabric had to be very carefully guided to maintain the edge that predetermined distance from the needle. In order to aid the operator in this regard, various edge guides have been developed including, for example, the use of scribed lines on the throat plate of the sewing machine. However, none of these designs actively controls the spacing between the edge of the work fabric and the line of stitches.

Accordingly, the subject invention is adapted to assist an operator in sewing a line of stitches a substantially constant predetermined distance from the edge of a work fabric by adjusting the lateral position of the needle to compensate for any straying of the edge of the work fabric from a desired line of travel. To achieve this result, there is provided on the bracket arm 16 a switch 46 which is utilized by the operator when it is desired to place the sewing machine 10 in its edge guiding mode of operation. To sense the position of the edge 44, there is provided an edge sensor 50, illustratively of the type described in U.S. Pat. No. 3,609,373, issued Sept. 28, 1971, the disclosure of which is hereby incorporated by reference herein. The edge sensor 50 includes a first photosensor 52 spaced one or two stitches in advance of the needle 20, and a second photosensor 54, both the sensors 52 and 54 being located in the bed plate 56. The sensor 52 has an elongated bar configuration and its position is adjustable in the longitudinal direction thereof to establish the desired position of the edge 44 at the center of the sensor 52. With the sensor 52 so adjusted, the lateral distance between the center of the sensor 52 and the center needle position is equal to the desired spacing between the line of stitches 42 and the edge 44. The sensor 54 is a reference sensor that is positioned in an area that would most likely be covered by the work fabric 32 at all times during a normal sewing operation. This sensor 54 is used to monitor the material transparency so as to supply information used to correct the signal from the sensor 52 so that it contains information related only to the positional error of the edge 44. As fully disclosed and described in the referenced U.S. Pat. No. 3,609,373, in particular with respect to FIG. 2*b* thereof, a voltage is provided on the lead 58 which is representative of the position of the edge 44 with respect to the center of the sensor 52, which in turn is representative of the difference between the actual and desired positions of the edge 44. Circuit component values within the edge sensor 50 are chosen so that when the edge 44 is centered over the sensor 52, the voltage on the lead 58 is zero, with negative voltages corresponding to more of the sensor 52 being covered by the work fabric 32 and positive voltages corresponding to less of the sensor 52 being covered by the work fabric 32.

As described and disclosed in the aforereferenced U.S. Pat. No. 3,984,745, stitch pattern information is stored in pattern ROM 60 in the form of digital signals for controlling the bight actuator 30 and the feed actuator (not shown). The feed information signals are transmitted from the pattern ROM 60 to the feed actuator system 62 at the appropriate time. Likewise, the bight information signals are transmitted to the bight actuator system 64, which includes the actuator 30, at the appropriate time, through the gates 66 to the latch 68. However, when the edge guide switch 46 is closed, the transmission gates for the bight information from the pattern ROM 60 are disabled and instead, the transmission gates from the analog to digital converter circuit 70 are enabled. The input to the analog to digital converter 70 is the positional information on the lead 58 from the edge sensor 50, this information corresponding to the lateral position which must be assumed by the needle 20 in order to maintain the substantially constant predetermined distance between the edge 44 and the line of stitches 42.

In summary, when the operator desires to sew a line of stitches a substantially constant predetermined distance from the edge of a work piece, the sewing machine 10 is put in its straight stitch mode of operation and the edge guide switch 46 is operated to the ON position. The longitudinal position of the sensor 52 is adjusted by the operator so that the center of the sensor 52 is lined up with the desired position for the edge 44 of the work fabric 32, preferably with the needle 20 in its center position. The sewing machine is then operated and the aforedescribed arrangement compensates for lateral movement of the work fabric 32. It is understood that the aforedescribed arrangement is only effective within the maximum permissible lateral excursion range of the needle 20. If the work fabric 32 strays beyond this limit, it must be guided within this limit by the operator.

Accordingly, there has been disclosed an arrangement for sewing a line of stitches a substantially constant predetermined distance from an edge of a work fabric. It is understood that the above-described arrangement is merely illustrative of the application of the principles of this invention. Numerous other arrangements may be devised by those skilled in the art without departing from the spirit and scope of this invention, as defined by the appended claims.

I claim:

1. In a sewing machine having an endwise reciprocable needle movable laterally with respect to the direction of work feed and jogging means for effecting lateral positioning of the needle, an arrangement for controlling the sewing of a line of stitches a substantially constant predetermined distance from the edge of a work fabric comprising:

means for sensing the location of said edge in the general vicinity of the needle and for providing a signal representative of the distance between said edge and said needle; and means responsive to said signal for controlling the jogging means to laterally position said needle said predetermined distance from said edge.

2. The arrangement according to claim 1 further including means for providing an adjustable operator controlled setting for said predetermined distance.

3. In a sewing machine having an endwise reciprocable needle movable laterally with respect to the direction of work feed, an arrangement for controlling the sewing of a line of stitches a substantially constant predetermined distance from the edge of a work fabric comprising:

means for establishing a desired position for said edge;

means for sensing the actual position of said edge;

means for providing a signal representative of the difference between said actual position and said desired position; and means utilizing said signal for controlling the lateral position of said needle.

* * * * *